US005560402A

United States Patent [19]

Bates

[11] Patent Number: 5,560,402

[45] Date of Patent: Oct. 1, 1996

[54] REVERSIBLE DIRECTION WIRE TWISTING PLIERS

[75] Inventor: Darryle E. Bates, Stowe, Ohio

[73] Assignee: Milbar Corporation, Chagrin Falls, Ohio

[21] Appl. No.: 243,813

[22] Filed: May 17, 1994

[51] Int. Cl.[6] ..... B21F 15/04

[52] U.S. Cl. ..... 140/118; 74/127; 140/121

[58] Field of Search ..... 140/118, 119, 140/121; 81/58.4; 74/127

[56] References Cited

U.S. PATENT DOCUMENTS

| | | | |
|---|---|---|---|
| 468,005 | 2/1892 | Newitt . | |
| 942,571 | 12/1909 | Leland | 74/127 |
| 1,436,637 | 11/1922 | Bates . | |
| 2,300,392 | 11/1942 | Austin . | |
| 2,481,622 | 9/1949 | Wehner . | |
| 2,521,816 | 9/1950 | Adams . | |
| 2,646,687 | 7/1953 | De Wald | 74/127 |
| 2,737,983 | 3/1956 | Pray . | |
| 2,960,132 | 11/1960 | Finkeldei | 74/127 |
| 4,665,953 | 5/1987 | Randall . | |
| 4,842,025 | 6/1989 | Box et al. . | |
| 5,211,209 | 5/1993 | Geibel et al. . | |

*Primary Examiner*—Lowell A. Larson

*Attorney, Agent, or Firm*—Calfee, Halter & Griswold

[57] ABSTRACT

A reversible wire twisting plier tool is provided, which includes a pair of plier arms each having a jaw portion and a handle portion and which are pivotally interconnected and movable between an open position and a closed position. A plier rotating mechanism is mounted on one of the handles. The rotating mechanism includes a tubular member and a double spiral shank having a left hand groove and a right hand groove, axially slidably mounted within the tubular member. First and second gears are disposed within the tubular member, one gear being slidably engaged in one of said grooves and the other being slidably engaged in the other groove. A gear actuator is provided which is movable between a first actuated position wherein the actuator engages the first gear and a second actuated position wherein the actuator engages the second gear to selectively impart a clockwise or counterclockwise motion to the shaft depending upon which gear means is engaged. A reversing mechanism is mounted on the tubular member and connected to the gear actuator. The reversing mechanism includes a sleeve which is rotatably movable between first and second positions corresponding to the first and second actuated positions of the gear actuator. A mechanism is also provided to releasably latch the pliers in the closed position and automatically release the pliers from the closed position upon squeezing thereof.

4 Claims, 8 Drawing Sheets

REVERSIBLE DIRECTION WIRE TWISTING PLIERS

FIELD OF THE INVENTION

This invention relates generally to plier type hand tools, and more particularly to plier-type hand tools adapted to perform a twisting operation on wires. In even more particular aspects, this invention relates to a wire twisting plier-type tool which can be easily and quickly set in either a clockwise or counterclockwise direction of twisting using a single hand by utilizing a rotatable sleeve. In still further aspects, this invention relates to a plier-type hand tool for twisting wire in either a clockwise or counterclockwise direction, which requires digital intervention to lock onto a wire, and which will automatically release its locking position when squeezed.

BACKGROUND ART

There have been many different prior art patents relating to so-called wire twisting pliers, and several of these patents have addressed the question of reversible twisting or twisting in opposite directions, i.e., having the pliers capable of twisting either in a clockwise or counterclockwise direction.

One particular reversible type wire twisting plier is shown and described in U.S. Pat. No. 4,665,953 to Randall. This plier utilizes a conventional "yankee" mechanism mounted on one of the handles of a plier device, and incorporates the conventional "yankee" type flat sliding switch to reverse directions. This plier also incorporates an automatic locking feature wherein when the plier handles are squeezed to a closed position, the pliers automatically lock in this closed or gripping position and require digital intervention to allow for the opening of the pliers. This particular prior art device has several drawbacks. One drawback is the relative difficulty in accessing the reversing slide to reverse the direction of twisting and the absence of any readily visible or apparent indicia to indicate for which direction of rotation the pliers are set. Further, the locking feature on this plier automatically locks the pliers each time the handles are squeezed to close the jaws; and thus, every time the pliers are used whether or not for twisting, the pliers will lock in the closed position and require digital intervention for unlocking. This is time consuming especially in situations where a relatively minor portion of the use of the pliers is for twisting thus requiring positive unlocking every time the pliers are used.

Other devices which incorporate types of twisting include U.S. Pat. No. 2,737,983 to Prey. This patent also provides for twisting in a clockwise or counterclockwise direction but again utilizes a slide button for reversing.

Other types of rotating mechanisms are shown in U.S. Pat. No. 1,436,637 to Bates, U.S. Pat. No. 2,300,392 to Austin, U.S. Pat. No. 2,521,816 to Adams and U.S. Pat. No. 2,481,633 to Wehner. None of these patents show an actuator mechanism for reversing the direction and a locking mechanism which will not automatically lock upon closure.

U.S. Pat. No. 5,211,209, assigned to the assignee of the present invention, discloses a reversible plier type tool, wherein the direction is reversed by a mechanism which is axially slidable on the tube sleeve housing the rotary mechanism. This is a substantial improvement over the prior art tools. However, the axially movable sliding mechanism is prone to be inadvertently changed by the operator unintentionally moving the slide during manipulation of the tool thus changing the rotational direction of the operation of the tool.

SUMMARY OF THE INVENTION

According to the present invention a reversible wire twisting plier tool is provided. The tool includes a pair of plier arms each having a jaw portion and a handle portion. The plier arms are pivotally interconnected and movable between an open position and a closed position. A plier rotating device is provided and mounted on one of the handles. The plier rotating device includes a tube and a double spiral shaft having a left hand groove and a right hand groove, the shaft being axially slidably mounted within the tube. First and second gear members are disposed within the tube, one gear member being slidably engaged in one of said grooves and the other gear member being slidably engaged in the other of said grooves. A gear actuation member is provided which is operably associated with the tube and which is movable between a first actuated position wherein said gear actuation mechanism engages the first gear mechanism and a second actuated position wherein said gear actuation mechanism engages the second gear mechanism to thereby selectively impart a clockwise or counterclockwise motion to said shaft with respect to said tube depending upon which gear member is engaged. An annular shift mechanism is mounted on the tube externally thereof which is operably connected to the gear actuation mechanism. The shift mechanism is rotatably movable on the tube between first and second shift member positions corresponding to said first and second actuated positions of the gear actuation means. A latch device is also provided to releasably secure or latch said plier arms in the closed position and automatically release the pliers from the latched configuration upon squeezing thereof.

DESCRIPTION OF THE PREFERRED EMBODIMENT

Figure 1:
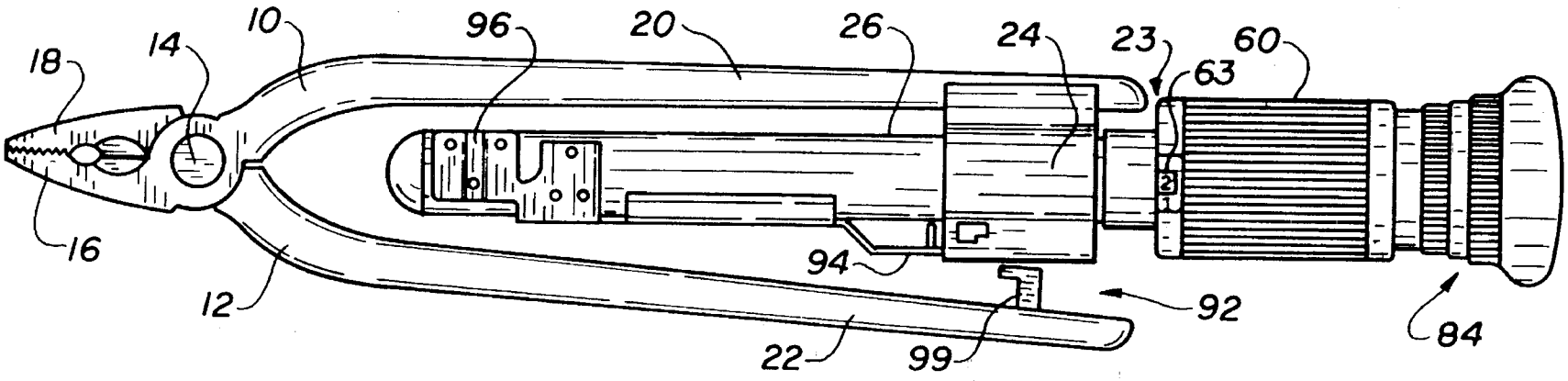
FIG. 1 is a side elevational view of a reversible twisting plier tool according to this invention showing the jaws closed but the handles unlatched.

Referring now to the drawings reversible wire twisting pliers according to the present invention are shown. The pliers include a pair of plier arms 10, 12 which are pivotally interconnected intermediate their opposite ends by means of a pivot pin 14. The plier arms 10 and 12 have respectively at one end thereof jaw portions 16, 18 and at the opposite end handle portions 20, 22, respectively. The handle portions and jaw portions are conventional and operate in a conventional manner for plier type hand tools. The pivot arms 10, 12 are pivotally movable between an open position and a closed position in a conventional manner.

Figure 2:
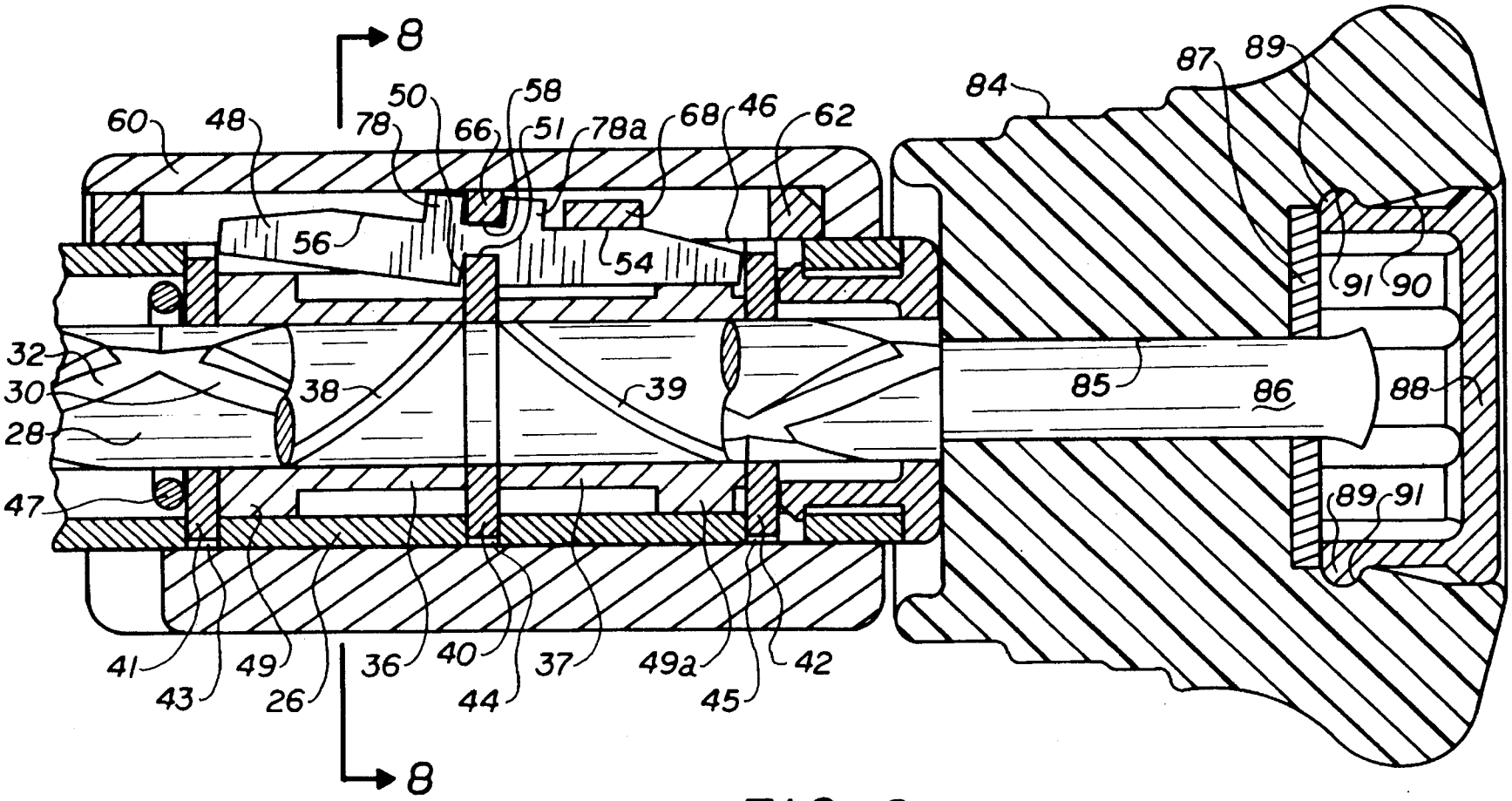
FIG. 2 is a longitudinal sectional view of the reversing mechanism of the present invention shown in position for actuation for twisting in one direction of rotation.
Figure 2A:
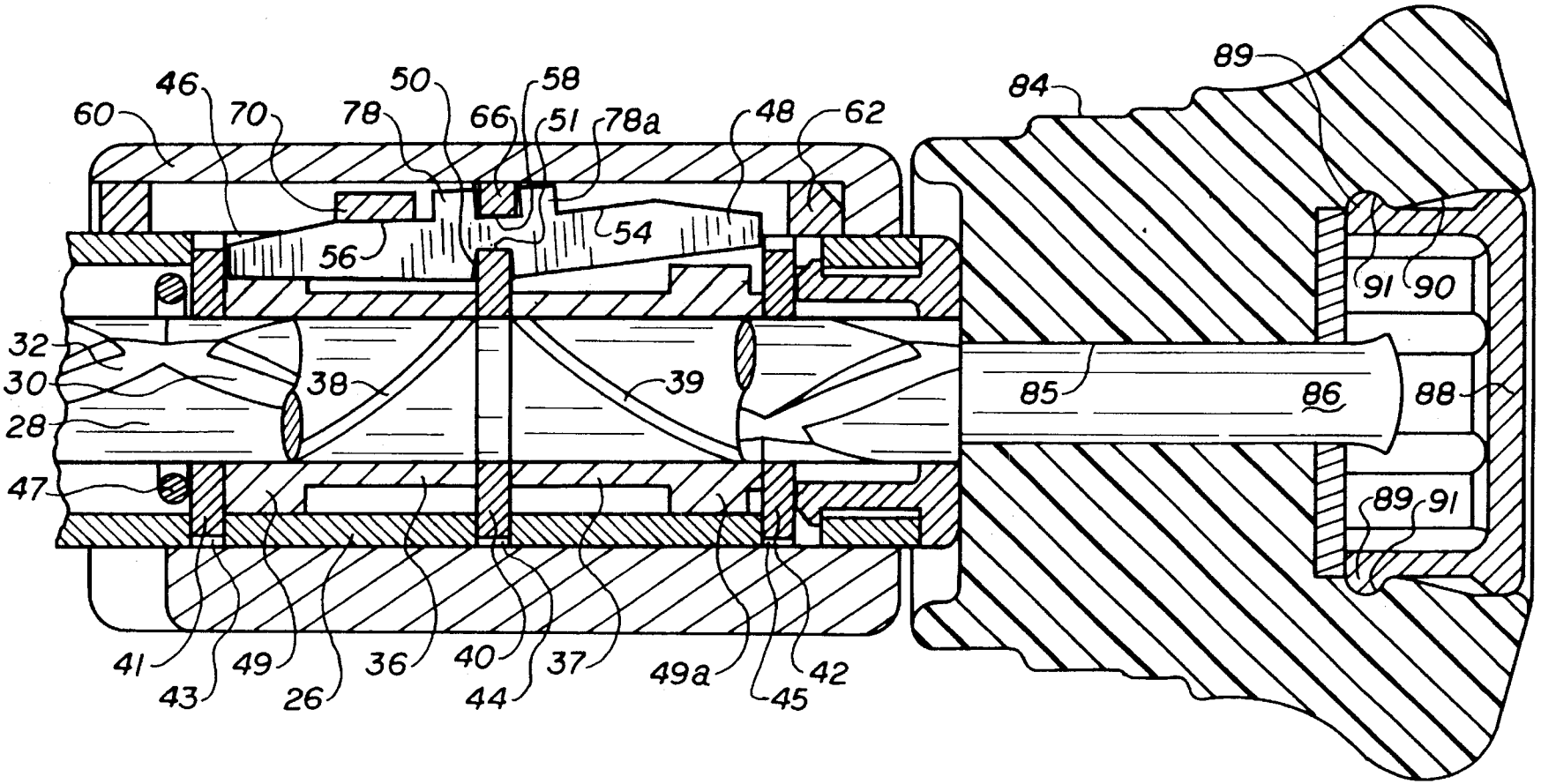
FIG. 2A is a longitudinal sectional similar to FIG. 2 of a portion of the reversing mechanism showing the actuation position for twisting in the opposite direction from FIG. 2.
Figure 3:
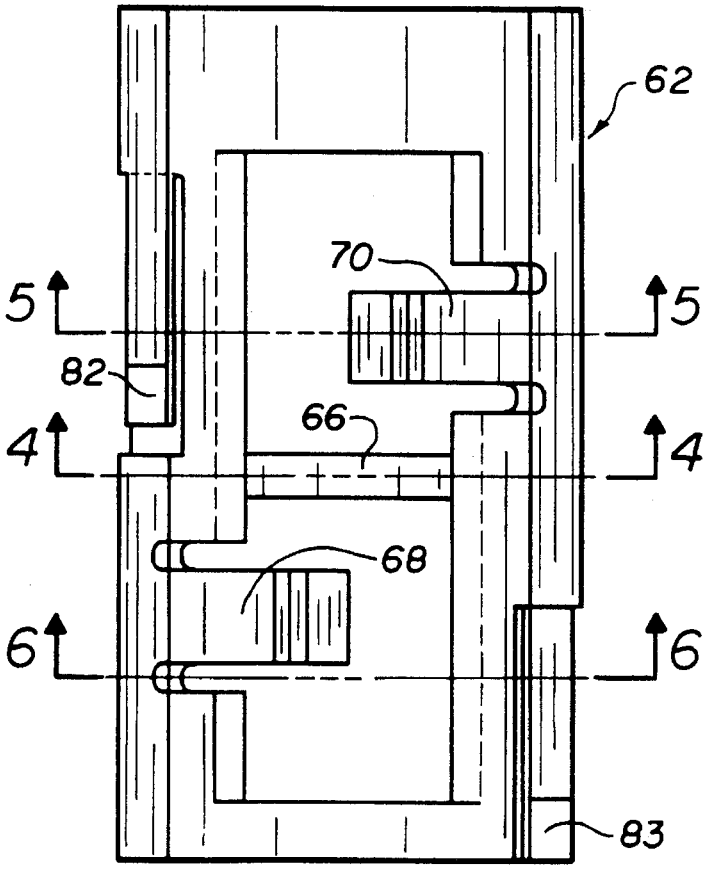
FIG. 3 is a plan view of the sleeve insert utilized in the device of this invention.
Figure 4:
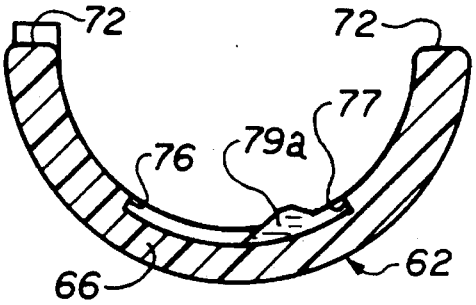
FIG. 4 is a sectional view taken substantially along the plane designated by the line 4—4 of FIG. 3.
Figure 5:
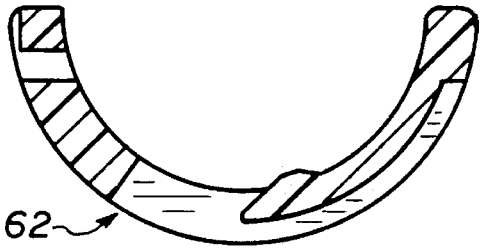
FIG. 5 is a sectional view taken substantially along the plane designated by the line 5—5 of FIG. 3.
Figure 6:
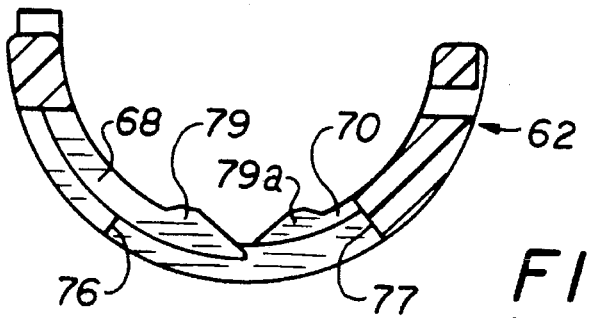
FIG. 6 is a sectional view taken substantially along the plane designated by the line 6—6 of FIG. 3.
Figure 7:
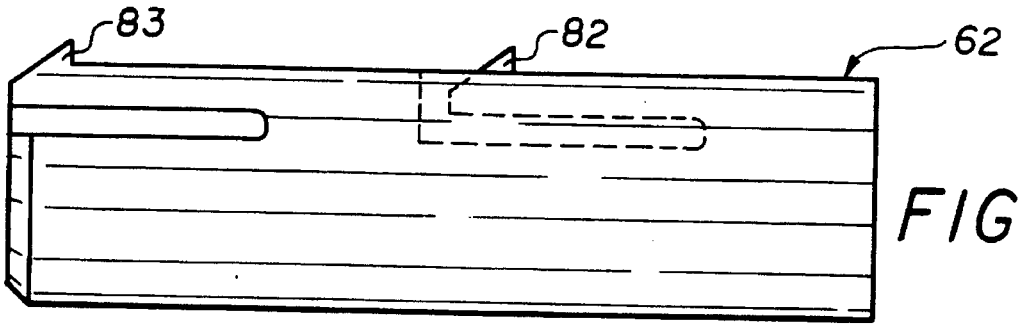
FIG. 7 is a side elevational of the sleeve insert.

Mounted on the handle portion 20 is a twisting mechanism designated generally by the reference character 23, the mounting thereon being by a bracket 24 secured to handle portion 20. The twisting mechanism as constituted in many respects is similar to a conventional "yankee" type mechanism which is shown and described in detail in the Randall U.S. Pat. No. 4,665,953 and in U.S. Pat. No. 5,211,209 which is incorporated herein by reference. The twisting mechanism includes a tubular member or tube 26 which has disposed therein a shaft 28. As can be seen in FIG. 2, the shaft 28 has a right hand (clockwise) groove 30 and a left hand (counterclockwise) groove 32 which in conjunction with gears and actuators, to be described presently, will impart selectively either a right hand rotation of the tube 26 or a left hand rotation of the tube 26 with respect to the shaft when pulled to the right, i.e. either a clockwise or counterclockwise rotation.

Figure 8:
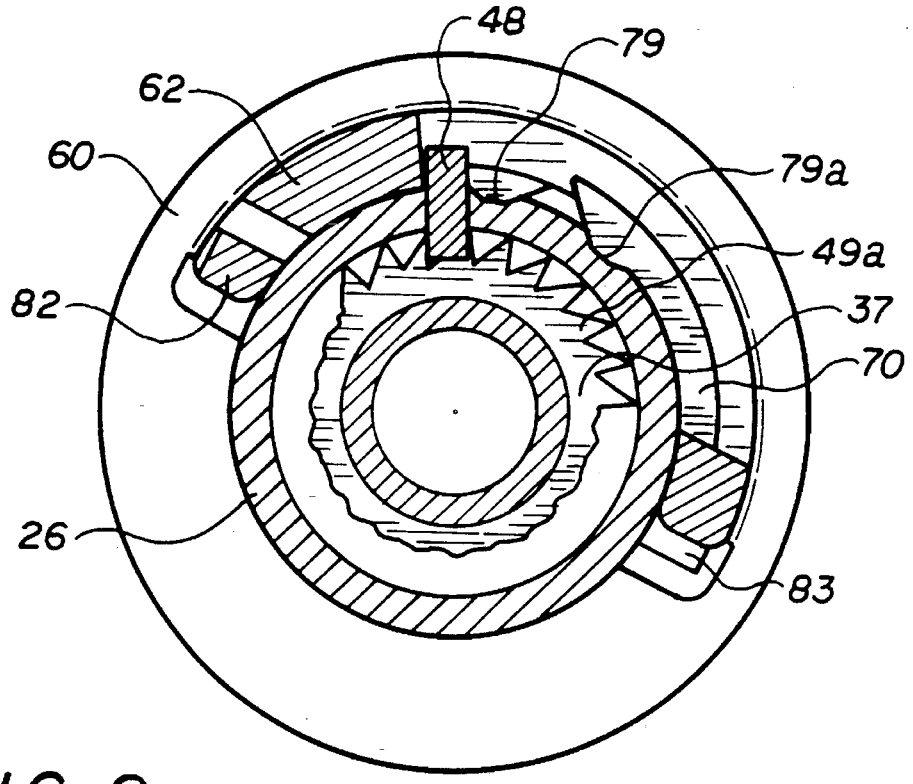
FIG. 8 is a sectional view taken substantially along the plane designated by the line 8—8 of FIG. 2.
Figure 9:
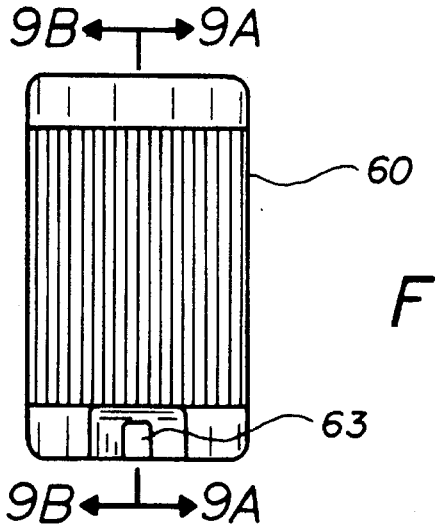
FIG. 9 is an elevational view of the rotatable sleeve.
Figure 9A:
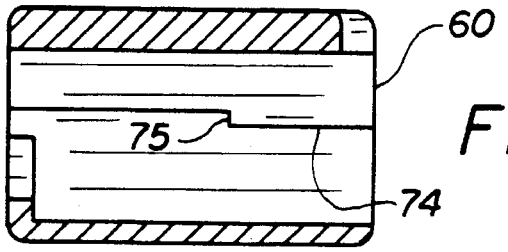
FIG. 9A is a sectional view taken substantially along a plane designated by the line 9A—9A of FIG. 9.
Figure 9B:
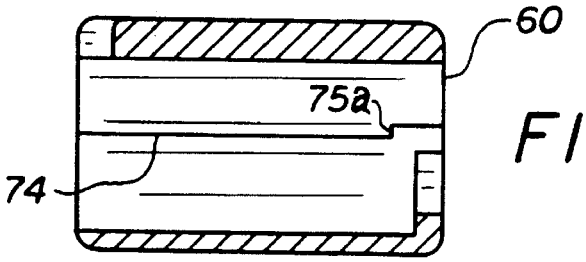
FIG. 9B is a sectional view taken substantially along the plane designated by the line 9B—9B of FIG. 9.

Referring now to FIGS. 2 and 8, disposed within the tube 26 are a pair of gears 36 and 37 having lands 38 and 39 respectively which engage respectively the clockwise groove 30 of the shaft 28 and the counterclockwise groove 32 of the shaft 28. A washer 40 is interposed between the gears 36 and 37 which acts as a spacer between the two gears. The washer 40 also serves a fulcrum for a portion of the gear actuating mechanism as will be described presently.

Second and third washers 41, 42 identical to and separated equally from washer 40, capture gears 36, 37 to limit their axial travel during operation. These three washers are inserted and positioned in tube 26 via three slots 43, 44, 45 formed perpendicular to tube centerline. Washer 41 also serves as a spring retainer for spring 47, which surrounds shaft 28 and also abuts "C" ring at the opposite end (not shown). The spring compresses during operation of the twisting mechanism and will provide an automated return upon release as will be described presently.

The tube 26 also has a longitudinally extending slot 46 formed therein and in which is disposed a rocker arm 48. The rocker arm 48 is provided with a pivot notch 50 which engages a fulcrum portion 51 of washer 40 thus allowing the rocker arm 48 to rock in a direction or on a plane parallel to the axis of the shaft 28. This will provide for the selective engagement of the rocker arm 48 with gear teeth 49, **49*a* of gears 36, 37, respectively, as will be described presently. The rocker arm 48 is provided with a pair of actuating surfaces 54 and 56 on the opposite sides of the pivot notch 50 the purpose of which will be described presently. The rocker arm 48 is also provided with a locating slot 58** the purpose of which will be described presently.

An annular sleeve 60 is provided which is rotatably mounted on the tube 26 but which is constrained from axial movement as will be described presently. As can best be seen in FIGS. 2 through 6, the annular sleeve 60 is provided with a sleeve insert 62 which cooperates with the rocker arm 48 to provide for shifting or reversing of the rotational movement of the shaft between a clock wise and counter clockwise direction. To this end, a central projection 66 which resides in slot 58 of the rocker arm 48 precludes axial movement of insert 62. On opposite sides of the central projection 66 are a pair of flexural beams 68 and 70 which co-act respectively with actuating surfaces 54 and 56 of the rocker arm 48. The sleeve insert 62 includes a flange portion 72 which abuts against ledges 74 formed in sleeve 60 to maintain the sleeve insert 62 circumferentially in place on the sleeve 60. The sleeve insert 62 is also provided with a pair of stop tabs 76, 77 circumferentially spaced thereon which stop tabs are positioned to selectively abut against tabs 78, 78a of rocker arm 48 and limit rotational movement of sleeve and insert assembly. The sleeve can be made of any impact-resisting, rigid material, such as glass filled nylon. The sleeve insert can be made of any of various resilient materials such as Delrin, manufactured by DuPont Corp. The beams 68, 70 have radially inward protuberances 79, **79*a* that impart additional loading on beams 68, 70 as they ride over rocker arm 48. As the additional loading is released, this release of force tactilely informs the user that the shifting mechanism is fully engaged. These protuberances act in conjunction with stop tabs 76, 77 to rotationally lock the shifting mechanism in place and prohibit unintended rotation of sleeve 60 and insert 62**.

The sleeve 60 also has a window 63 that reveals lettering stamped on tube 26 to identify the plier rotation direction (L for left hand, or CCW; R for right hand, or CW) when in fully engaged position.

Figure 10:
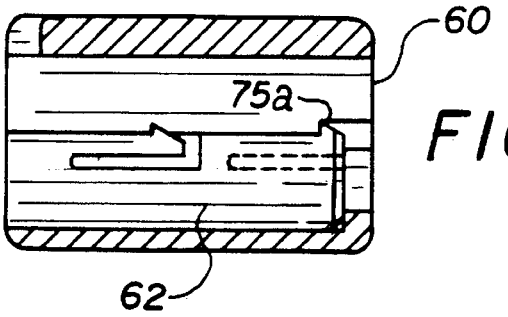
FIG. 10 is a detailed view showing the interconnection of the sleeve and sleeve insert.

The insert 62 has locking tabs 82, 83 thereon positioned to co-act with shoulders 75, **75*a* on the sleeve 60 such that when the sleeve 60 is pushed into place over sleeve insert 62 and is firmly engaged, it cannot be removed therefrom axially; moreover sleeve 60 cannot move rotatably beyond tabs 76 and 77 nor axially beyond projection 66 without destroying the sleeve insert 62 as shown in FIG. 10**.

Figure 11:
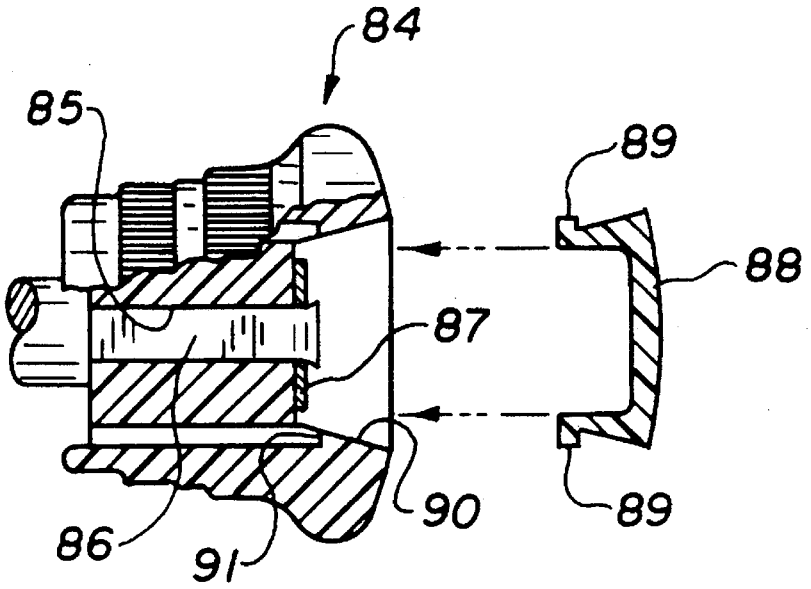
FIG. 11 is a longitudinal sectional view of the knob and plug ready for insert.
Figure 12:
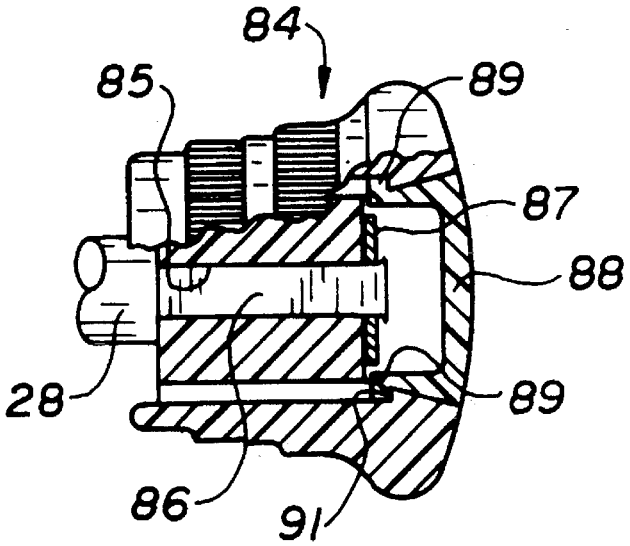
FIG. 12 is a longitudinal sectional view of the knob and plug in the assembled condition.

To complete the assembly, and as shown in FIGS. 11 and 12, a knob 84 is attached to the end of the shaft 28. The knob 84 has a square central opening 85 which co-acts with the end 86 of the shaft 28 which also is square. The end 86 of the shaft 28 is crimped over the knob with a washer 87 interposed therebetween. A plug 88 is provided which has a pair of resilient legs 89 formed on one end thereof. The plug 88 is disposed to be slid into opening 90 at the end of the knob 84 and the legs will then resiliently expand to engage shoulder 91 formed in the interior of the knob 84 so that the plug is firmly in place. The knob is preferably formed of glass-filled nylon, and the plug also is preferably formed of glass-filled nylon.

Figure 13:
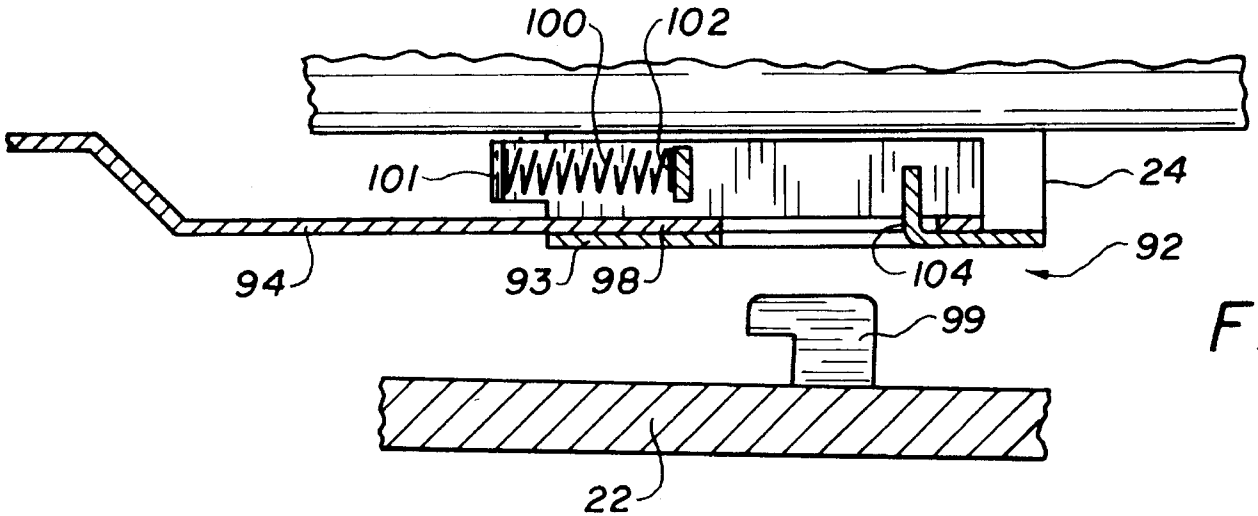
FIG. 13 is a longitudinal sectional view of the latching mechanism in the unlatched configuration.
Figure 14:
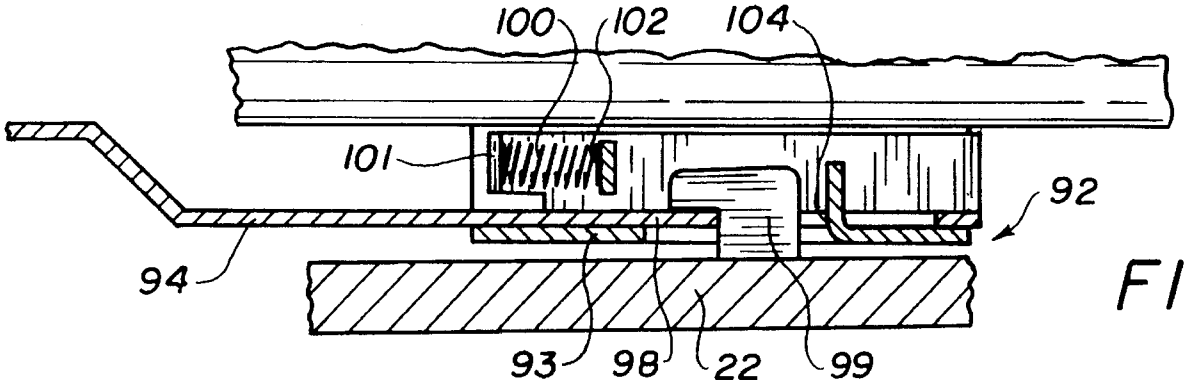
FIG. 14 is a longitudinal sectional view of the latching mechanism in the latched configuration.

The pliers are also provided with a latching mechanism designated generally by the reference character 92. The latching mechanism (FIGS. 1, 13 and 14) is shown in the unlatched position in FIG. 13 and the closed, or latched, or locked, position in FIG. 14. The latching mechanism is the same as shown and described in U.S. Pat. No. 5,211,209, and includes a housing 93 formed on one side of the bracket 24, which housing 93 slidably mounts a latch lever 94. The end of the latch lever 94 is formed with a thimble 96 surrounding the sleeve 26 (FIG. 1) which can be reached by the thumb of an operator. The latch lever 94 includes a latch plate 98 adapted to engage a catch 99 formed on the handle position 22. A compression spring 100 is captivated between shoulder 101 on the latch lever 94 and a surface 102 on housing 93. A slot or opening 104 is formed in the housing 93 to receive the catch 99. The spring 100 normally biases the latch lever 94 to the left as seen in FIGS. 1, 13, and 14 leaving the slot 104 open for the receipt of the catch 99 (FIG. 13). When the handles 20, 22 are squeezed together after the jaws 16, 18 have been closed, the resiliency of the handles will cause the catch 99 to enter the slot 104. To lock or latch the pliers, the operator engages the thimble 96 with his or her thumb and slides the latch lever to the right (as seen in FIGS. 1, 13, and 14). By slightly releasing pressure on the handles 20, 22, the catch 99 engages the latch plate 98, and the resiliency of the handles 20, 22 maintains the catch 99 in contact with the latch plate 98, and the friction between the latch plate 98 and catch 99 maintains the pliers latched or closed.

To release the pliers from the latched position, one merely need squeeze the handles of the pliers together which will move the catch 99 out of contact with the latch plate 98. The urging of the spring 100 will then move the slidable latch lever 94 to the left moving the latch plate 98 out of the slot 104, thus, allowing the pliers to open and close and operate in a normal manner.

Operation

In order to operate the device, the pliers are latched in the closed portion and the sleeve 60 is rotated either clockwise or counter-clockwise, rotation taking place until the appropriate protuberance 79, 79*a* is overridden on the appropriate actuating surface 54, 56 and appropriate stop tabs 76, 77 abut tabs 78, 78*a* on the rocker arm 48. Rotation of the sleeve 60 in the counterclockwise direction will cause the flexural beam 68 to bear against the actuating surface 54 of the rocker arm 48 thus causing the rocker arm 48 to pivot and engage gear teeth 49*a* and move out of engagement of gear teeth 49. Thus, gear 36 is free to rotate but gear 37 is held steady, i.e. is blocked from rotation by means of the rocker arm 48. Hence, pulling the knob 84 will cause the pliers to rotate in the counterclockwise direction caused by rotation of the gear lands 39 acting on the groove 32 in the shaft 28 upon release of the knob 84, the spring 47 will return the shaft to its original position in the tube 26. Preferably, the sleeve insert 62 with the flexural beams 68 and 70 thereon are configured so that rotation of the sleeve 60 in the clockwise direction will cause the pliers to rotate in a clockwise direction and rotation of the sleeve 60 in a counterclockwise direction will cause the plier to rotate in a counterclockwise direction. Identification of such is revealed through window 63.

To cause rotations in the opposite rotation, one merely rotates the sleeve 60 in the opposite direction from which it was rotated previously until the other of the protuberances 79, 79*a* is overridden and stop tabs 76, 77 abut tabs 78, 78*a* on the rocker arm. This rotation will cause the flexural beam 70 to engage the actuation surface 56 on rocker arm 48 and will cause the flexural beam 68 to move out of engagement with the actuating surface 54 of the rocker arm 48 thus allowing the rocker arm to pivot about the fulcrum 40 in the opposite direction so that it blocks gear 36 from rotating but allows 37 to rotate. The blocking of gear 36 will provide the opposite direction of rotation.

Thus, by rotatably moving the sleeve 60 in counterclockwise or clockwise direction, the pliers will be forced to rotate in a counterclockwise or clockwise direction, depending on the direction of rotation of the sleeve. Hence, the operator need not have any visual indication or retain any knowledge as to what direction the plier will go other than to know that rotation of the sleeve in a clockwise direction will cause the pliers to rotate clockwise, rotation counterclockwise will cause the pliers to rotate counterclockwise. However, should any visual indication be desired, it has been provided. Moreover, since the sleeve is not movable axially on the plier, it cannot be accidently bumped from one position to another during manipulation of the pliers by the operator.

Having thus described the preferred embodiment, the invention is now claimed to be:

1. Reversible wire twisting pliers comprising a pair of plier arms each having a jaw portion and a handle portion;

said arms being pivotally interconnected for movement between an open position and a closed position;

a plier rotating device mounted on one of said handle portions, said plier rotating device including a tubular member and a double spiral shank having a left hand groove and a right hand groove formed therein, said shank being axially slidably mounted within said tubular member;

first and second gear members carried within said tubular member, said first gear member being slidably engaged in one groove in said shaft and said other gear member being slidably engaged in the other groove in said shaft;

a gear actuation mechanism operably associated with said gear members and said tubular member and movable between a first actuated position wherein said first gear member is engaged and a second actuated position wherein said second gear member is engaged and wherein the engaged gear in the first actuated position will impart a counterclockwise motion and the gear engaged in the second actuated position will impart a clockwise motion to said shaft means, said gear actuating mechanism including a rocker arm pivotally mounted for movement between a first and a second position corresponding to said first and second actuated positions of said gear actuation mechanism, respectively;

a shift mechanism mounted externally on said tubular member operatively connected to said gear actuation mechanism, said shift mechanism having a sleeve selectively rotatable on said tubular member between first and second positions corresponding to said first and second gear actuated positions, an operating mechanism carried by said sleeve and rotatable therewith having a rocker arm actuating mechanism positioned to pivot said rocker arm to the first actuated position when the sleeve is in its first position and to pivot the rocker arm to the second actuated position when the sleeve is in its second position, said operating mechanism for moving said rocker arm including a flexural beam operative against said rocker arm.

2. The device as defined in claim 1 wherein said rocker arm is pivotally mounted on a pivot member disposed intermediate said first and second gear members, and there are first and second flexure beams, said first flexure beam being operable against the rocker arm on one side of the pivot member, and the second flexure beam being operable against the rocker arm on the other side of the pivot member.

3. The device as defined in claim 2 wherein each of said flexure beams have a protuberance positioned to override said flexure beam and detent at its respective first or second operating position.

4. Reversible wire twisting pliers comprising a pair of plier arms each having a jaw portion and a handle portion;

said arms being pivotally interconnected for movement between an open position and a closed position;

a plier rotating device mounted on one of said handle portions, said plier rotating device including a tubular member and a double spiral shank having a left hand groove and a right hand groove formed therein, said shank being axially slidably mounted within said tubular member;

first and second gear members carried within said tubular member, said first gear member being slidably engaged in one groove in said shaft and said other gear member being slidably engaged in the other groove in said shaft;

a gear actuation mechanism operably associated with said gear members and said tubular member and movable between a first actuated position wherein said first gear member is engaged and a second actuated position wherein said second gear member is engaged and wherein the engaged gear in the first actuated position will impart a counterclockwise motion and the gear engaged in the second actuated position will impart a clockwise motion to said shaft means, said gear actuating mechanism including a rocker arm pivotally mounted for movement between a first and a second position corresponding to said first and second actuated positions of said gear actuation mechanism, respectively;

a shift mechanism mounted externally on said tubular member operatively connected to said gear actuation mechanism, said shift mechanism having a sleeve selectively rotatable on said tubular member between first and second positions corresponding to said first and second gear actuated positions, an operating mechanism carried by said sleeve and rotatable therewith having a rocker arm actuating mechanism positioned to pivot said rocker arm to the first actuated position when the sleeve is in its first position and to pivot the rocker arm to the second actuated position when the sleeve is in its second position, said operating mechanism and said rocker arm having coacting stop surfaces to define said first and second gear actuated positions.

* * * * *